US005462247A

United States Patent [19]

Aldrich

[11] Patent Number: 5,462,247

[45] Date of Patent: Oct. 31, 1995

[54] SUPPORT PAD FOR A STENOGRAPHER MACHINE

[76] Inventor: Stephen H. Aldrich, 5171 N. Five Mile Rd., Hope, Mich. 48628

[21] Appl. No.: 297,146

[22] Filed: Aug. 29, 1994

[51] Int. Cl.[6] ..... B68G 5/00

[52] U.S. Cl. ..... 248/118; 248/218.4; 248/286.1; 248/918; 400/715

[58] Field of Search ..... 248/118, 118.1, 248/118.3, 118.5, 918, 284, 278, 291, 286, 218.4, 295.1; 400/715

[56] References Cited

U.S. PATENT DOCUMENTS 4,932,620 6/1990 Foy ..... 248/286 X
4,976,407 12/1990 Schwartz et al. ..... 248/118.3
5,058,840 10/1991 Moss et al. ..... 248/118.5
5,104,073 4/1992 Van Beek et al. ..... 248/118.3
5,135,190 8/1992 Wilson ..... 248/118.1
5,402,972 4/1995 Schmidt ..... 248/118 X

*Primary Examiner*—Ramon O. Ramirez
*Attorney, Agent, or Firm*—Gifford, Krass, Groh, Sprinkle, Patmore, Anderson & Citkowski

[57] ABSTRACT

An adjustable pad support for use with a stenographer machine. A bracket has a horizontal member and a vertical member extending from the horizontal member. The horizontal member is mounted to a vertical support of the stenographer machine. A wrist support pad is mounted to a pad support plate and is horizontally adjustable with respect to said support plate. The support plate is mounted to the vertical member and is rotatable about a pivot point forming the connection with the vertical member.

12 Claims, 3 Drawing Sheets

SUPPORT PAD FOR A STENOGRAPHER MACHINE

BACKGROUND OF THE INVENTION

1. Field of the Invention

The present invention relates generally to support pads and, more particularly, to a mountable support pad for providing resting support to the wrists and forearms of a user of a stenographer machine.

2. Description of the Prior Art

Adjustable wrist support pads for supporting the wrists of a keyboard user are known in the art. U.S. Pat. No. 4,976,407, issued to Schwartz et al. teaches an adjustable wrist support which is affixed to an edge of a table top for providing adjustable wrist support for the operator of a computer keyboard. The device of Schwartz may be adjusted horizontally, vertically and pivotally.

U.S. Pat. No. 5,104,073, issued to VanBeck et al, teaches an arm and hand rest for a keyboard. A pair of opposing mirrored supports attach to a pad at one end and are slidably connected to a base at their other ends.

U.S. Pat. No. 5,058,840, issued to Moss et al, and U.S. Pat. No. 5,135,190, issued to Wilson, both teach other types of wrist and/or forearm supports.

The shortcomings of the above-described patents include their inability to provide a simple, yet effective device for supporting the wrists and forearms of a user. The prior art further does not teach the ability to adjust the pad member horizontally with respect to a support plate upon which the pad is affixed.

SUMMARY OF THE PRESENT INVENTION

The present invention is a wrist pad assembly for a stenographer machine which can be mounted to the base support of the stenographer machine. The pad assembly includes a bracket having a horizontal member and a vertical member connected to the horizontal member and extending at a right angle. An end of the horizontal member is adjustably secured to a vertically extending neck of a tripod base upon which the stenographer machine is supported. Similarly, a pad support plate is adjustably secured to a free end of the vertical member.

A wrist pad is mounted to the support plate by screws which extend through elongated slots in the support plate and which extend through apertures formed in a pad support base formed on the underside of the wrist pad. The pad is filled with a cushioned padding material which is durable in use and is covered by a likewise durable covering material. The pad is further contoured to conform to the edges of the stenographer pad. The pad assembly of the present invention may be adjusted both vertically and horizontally and the pad may be further rotationally adjusted so as to conform to the user.

BRIEF DESCRIPTION OF THE DRAWING

A better understanding of the present invention will be had upon reference to the attached drawings, wherein like reference numbers refer to like parts throughout the several views, and in which.

DESCRIPTION OF THE PREFERRED EMBODIMENT

Figure 1:
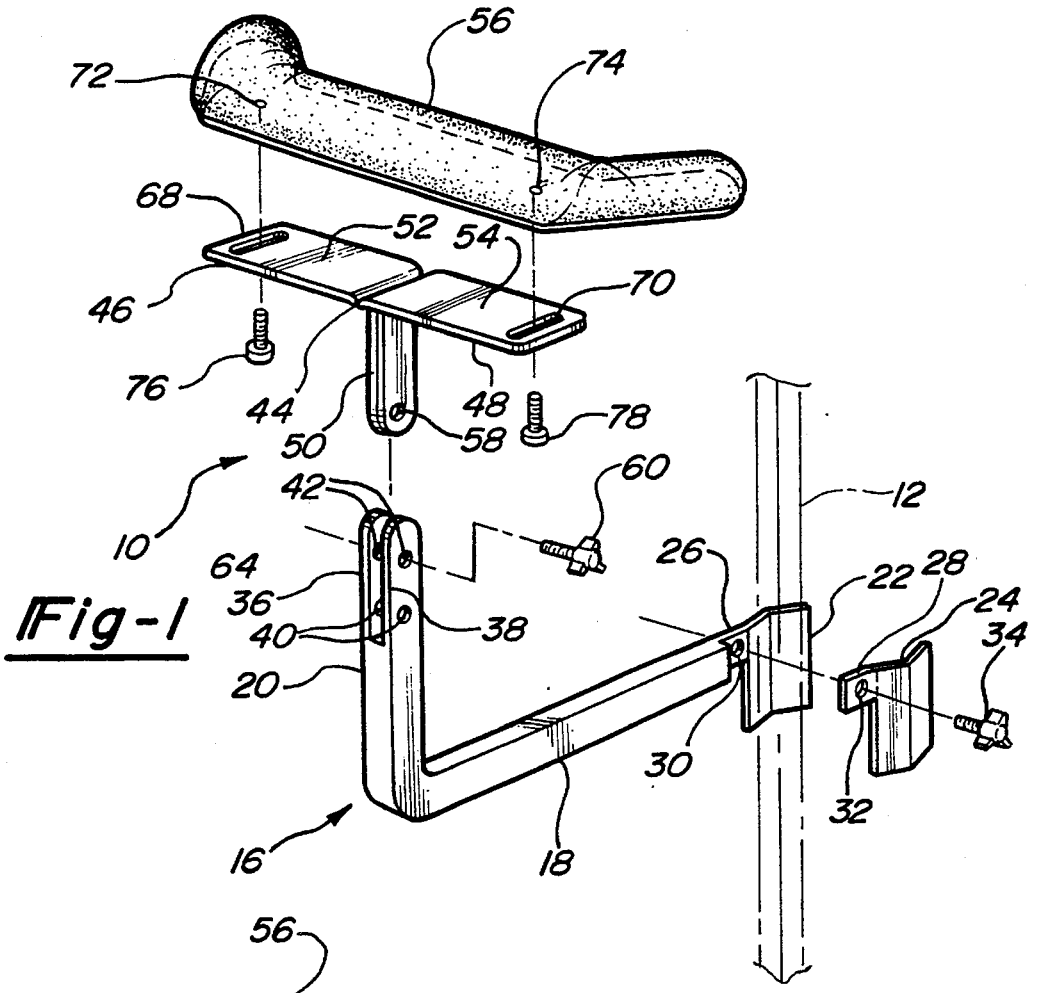
FIG. 1 is an exploded view in perspective of a first preferred embodiment of the support pad assembly of the present invention.
Figure 2:
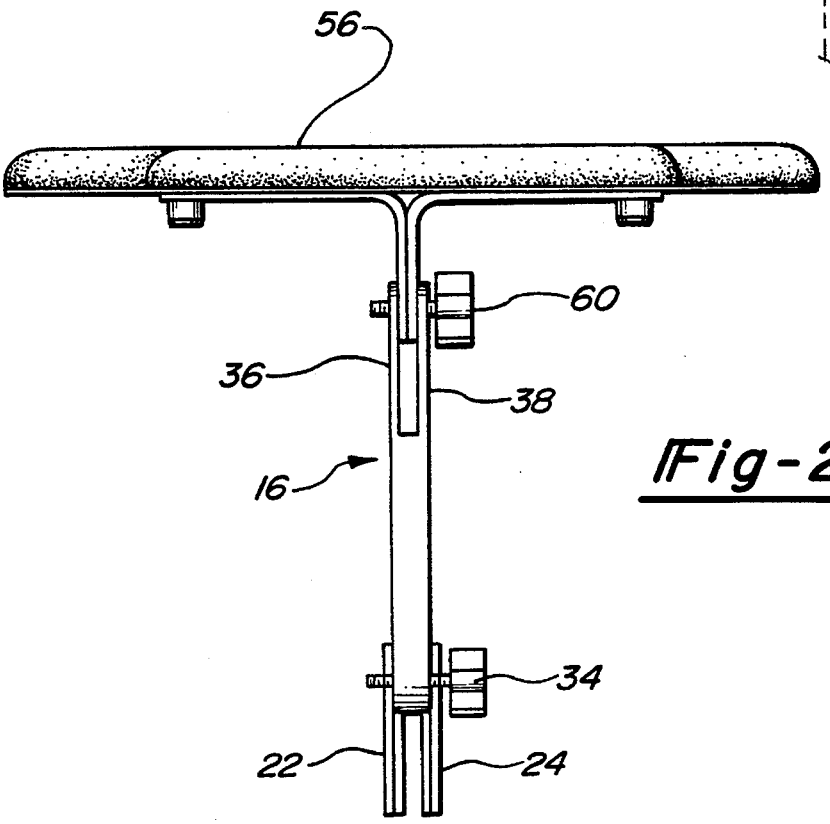
FIG. 2 is a frontal view of the support pad assembly similar to the view shown in FIG. 1.
Figure 3:
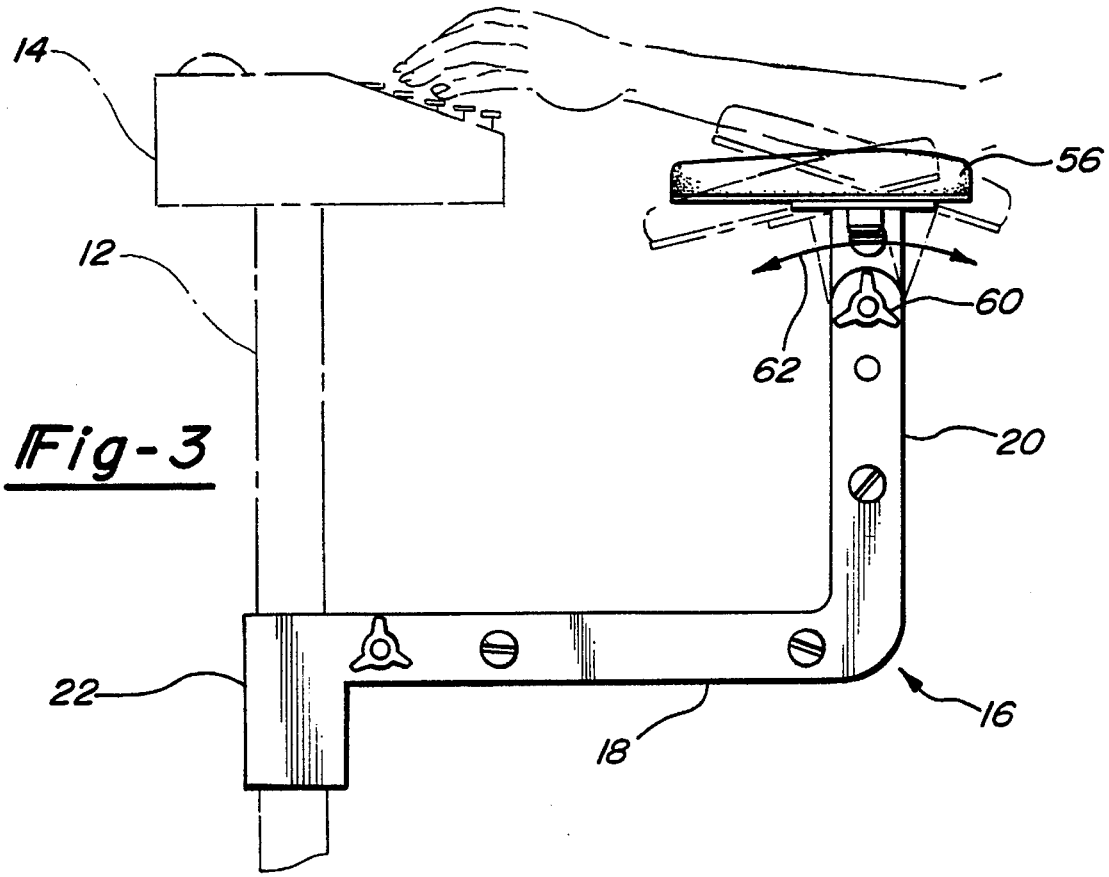
FIG. 3 is a side view of the support pad assembly and showing the range of rotation provided by the wrist pad support.

Referring to FIGS. 1 and 3, a wrist pad support assembly 10 is shown for mounting to an extending neck portion 12 of a tripod base (not shown) of a stenographic machine 14. Stenographic machines are used by persons such as court reporters for taking testimony and recording proceedings and must be portable in order to be used either in a courtroom or in a private deposition or the like.

A bracket 16 is made up of a horizontal member 18 and a vertical member 20. The bracket 16 may be constructed of a lightweight metal or durable plastic. The horizontal member 18 terminates in a first mounting plate 22 attached to the horizontal member 18. The first mounting plate 22 is contoured to fit around one side of the tripod neck 12 and mates with a second mounting plate 24 which is similarly contoured for surrounding the other side of the neck 12. The second mounting plate 24 does not extend from the horizontal member 18, as shown in FIG. 1.

A reduced portion 26 of the horizontal member 18 connects the first mounting plate 22 to the member 18. A tab portion 28 extends from the second mounting plate 24 and overlies the reduced portion 26 when the second mounting plate 24 is matingly engaged with the first mounting plate around the neck 12. The reduced portion 26 is provided with an aperture 30 and the tab portion 28 is provided with an aperture 32 which overlap when the mounting plate is 24 is engaged with the mounting plate 22. A threaded wing bolt 34 is threadably engaged with internal threads formed in the apertures 30 and 32 and is tightened to secure the bracket 16 to the neck 12 of the stenographer machine 14.

Referring again to FIGS. 1 and 3, the vertical member 20 of the bracket 16 terminates in a pair of fingers 36 and 38 which extend upwardly in the direction of the vertical member 20 and which define a hollow space therebetween. The fingers 36 and 38 each have a first pair of apertures 40 and a second pair of apertures 42 located a predetermined distance above the first pair of apertures 40. The first and second pairs of apertures 40 and 42 are horizontally aligned.

A pad support plate 44 is secured to the vertical member 20. The pad support plate 44 may be constructed of two half portions 46 and 48 as shown in FIG. 1. The pad support plate 44 is also preferably constructed from a lightweight metal or durable plastic material. The half portions 46 and 48 are welded together at base 50, with portion 46 having a horizontal support 52 and portion 48 having a horizontal support 54. The supports 52 and 54 extend in opposite directions from the base 50 and provide the support surface for pad 56. The pad 56 is filled with a durable cushioning material and is covered by an appropriate covering material as is known in the art. The pad 56 of the present invention helps to relieve the symptoms of Carpal Tunnel Syndrome in the hands and wrists of the user.

The base 50 is provided with an aperture 58 which aligns with either pair of apertures 40 and 42 of the vertical member 20. A threaded wing bolt 60 engages threads within the apertures to mount the support plate 44 at a lower position with respect to apertures 40 or an upper position with respect to apertures 42. The two-position vertical adjustment of the support plate 44 within either of the pairs of apertures 40 and 42 is in addition to the range of vertical adjustment made possible by the mounting plates 22 and 24 around the neck 12 and the tightening bolt 34 for mounting the bracket 16 at a given height with respect to the neck 12 of the tripod assembly.

Referring again to FIG. 3, the support plate 44 is rotationally adjustable, as shown by the curved arrow 62, about a horizontal axis 64 (see FIG. 1) formed by the connection of the support plate 44 to the bracket 16. The pad 56 is therefore rotationally adjustable at either the lower or upper positions of the bracket assembly 16 to accommodate the user.

Figure 4:
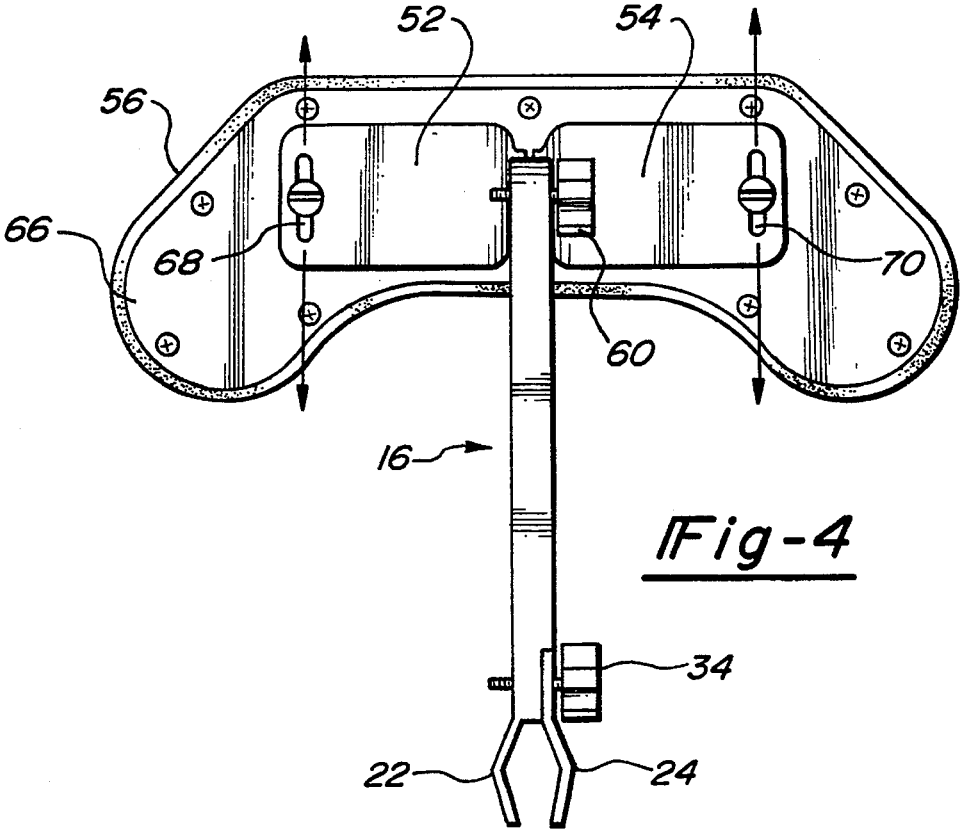
FIG. 4 is a bottom view of the wrist pad support and showing the horizontal adjustment feature of the pad support.

Referring again to FIG. 1 and to FIG. 4, the pad 56 is supported upon a solid base 66. The pad 56 and base 66 are contoured to provide a straight middle portion and angled edges to adequately support the users wrists during operation of the stenographer machine. The base 66 is mounted atop the support plate 44. A pair of elongated channels 68 and 70 are formed through the supports 52 and 54, respectively. The base 66 has a pair of mounting holes 72 and 74 formed therein which are internally threaded and which align with the elongated channels 68 and 70 when the pad 56 is placed atop the support plate 44. A pair of mounting bolts 76 and 78 are inserted through an underside of the channels 68 and 70 and threadably engage within the mounting holes 72 and 74. The elongated channels 68 and 70 permit the pad 56 to be horizontally adjustable to the most comfortable position for the user. Adjustment of the horizontal position of the pad is accomplished by loosening the bolts 76 and 78 and simply sliding the pad 56 to the desired position, whereupon the bolts are again retightened.

Figure 5:
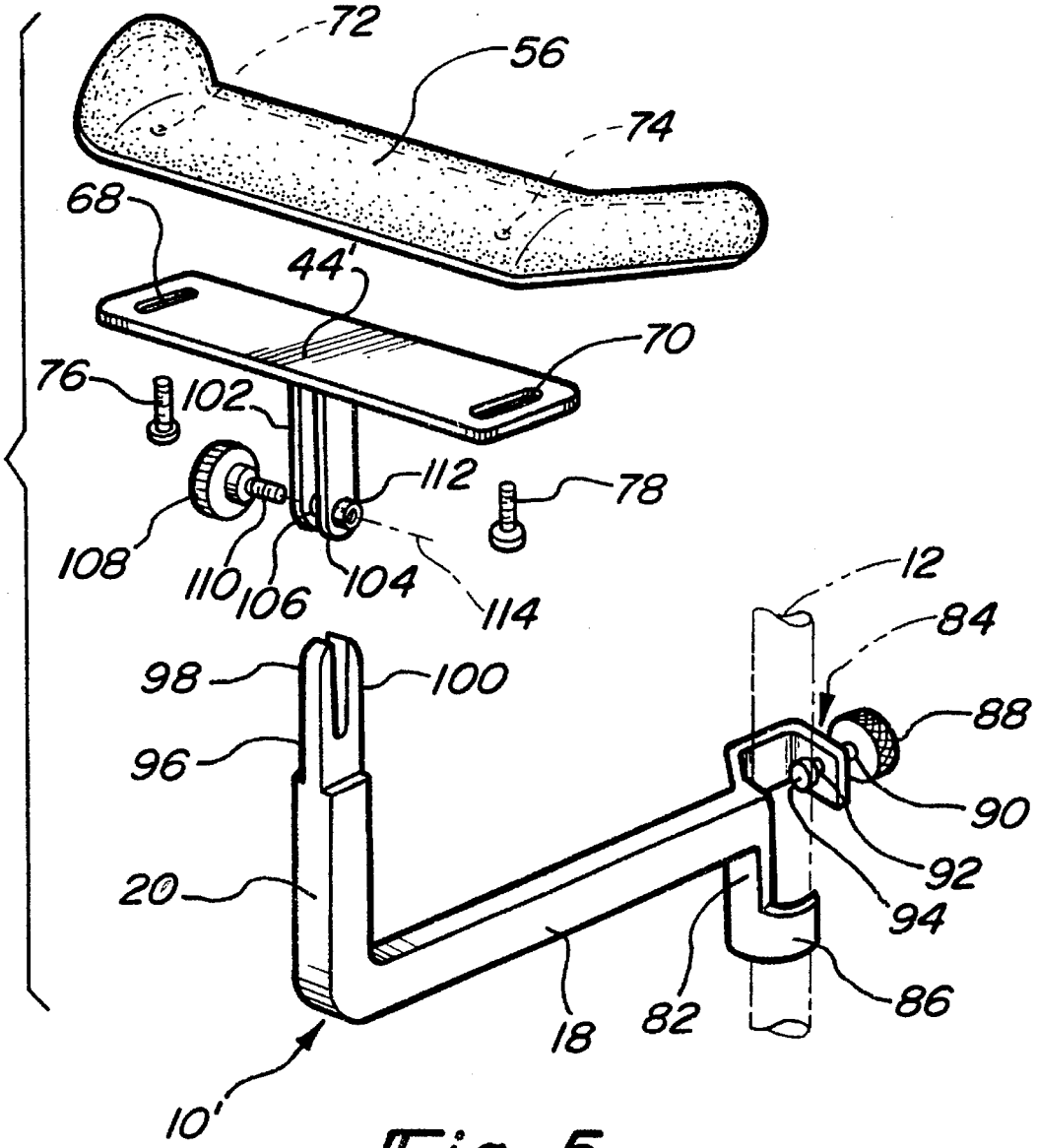
FIG. 5 is an exploded view in perspective of a second preferred embodiment of the support pad of the present invention.

Referring further to FIG. 5, a second preferred embodiment 10' of the present invention is shown. The embodiment of FIG. 5 is identical in many respects to the embodiment shown in FIGS. 1–4, therefore identical reference numerals are shown, where applicable.

In the place of the first and second mounting plates 22 and 24, the horizontal member 18 terminates in a clamp assembly 80. The clamp assembly 80 consists of a first gripping portion 82 and a second gripping portion 84. The first gripping portion 82 extends downwardly in a vertical direction from the horizontal member 18 while the second gripping portion 84 extends along the axis of the horizontal member 18 in a semicircular fashion from the horizontal member 18. The first gripping portion 82 terminates in a curved tab 86 which projects in a circumsential direction opposite the direction of the second gripping portion 84.

A knob 88 is provided with a threaded shaft 90 extending therefrom. The shaft 90 is rotationally engaged within a threaded aperture 92 formed in the second gripping portion 84. An inner portion 94 is attached to a free end of the threaded shaft 90. The inner portion 94 is preferably a nylon roller.

The first and second gripping portions 82 and 84 of the clamp assembly 80 are positioned around the neck 12 when it is desirable to mount the bracket 16. The knob 88, which can be knurled to enhance its grippability, is then rotated to advance the threaded shaft within the second gripping portion 84. The inner portion 94 attached to the shaft 90 comes into abutting contact with the neck 12 and secures the bracket to the neck 12.

Referring again to FIG. 5, the pair of fingers 36 and 38 shown in FIGS. 1–4 are replaced with an end portion 96 extending from the vertical member 20. The end portion 96 is of a one-piece construction and provides a pair of fingers 98 and 100. The fingers 98 and 100 are similar to the fingers 36 and 38 except that they create an inner slot or channel which is ninety degrees offset from the vertically extending open space shown in FIGS. 1–4.

A pad support plate 44' is identical to the pad support plate 44, except that it is constructed from a single piece. Projecting downwardly from the support plate 44' are a pair of spaced-apart members 102 and 104. The members 102 and 104 are both generally rectangular and have a semicircular shape at their free end. A pair of apertures 106 are located at the free ends of members 102 and 104 and are aligned. The members 102 and 104 overlap the ends of the channel formed between the fingers 98 and 100 when the support plate is to be mounted atop the bracket 16.

A knob 108 has a threaded shaft 110 extending therefrom which is insertable through the apertures 106 and the inner channel between fingers 98 and 100 when the members 102 and 104 are mounted over the end portion 96. An internally threaded nut 112 is welded over the aperture 106 of member 104 and is rotatingly received by the threaded shaft 110 to draw the members 102 and 104 against the fingers of the end portion 96.

The knob 108 and shift 110 can be selectively loosened and retightened to adjust the height of the support plate 44' relative to the end portion 96 and the rotational position of the support plate 44' relative to an axis 114 created by the thread shaft 110, the apertures 106 and the channel between fingers 98 and 100. The semicircular ends of the members 102 and 104 ensure clearance between the members 102 and 104 and the base of the end portion 96 when the plate 44' is to be rotated.

Accordingly, the present invention provides a wrist pad assembly which can be mounted to a neck of a tripod mount, or similar mount, of a stenographer machine. The pad assembly is adjustable along both horizontal and vertical axes, and is further rotationally adjustable to conform to the desire of the user.

Having described my invention, additional embodiments will become apparent to those skilled in the art to which the invention pertains. Specifically, the bracket assembly may be effectively mounted to other surfaces than the neck of a tripod mount. Other kinds of mounting means may also be employed for attaching the bracket to the tripod neck or similar support apparatus.

I claim:

1. An adjustable support for use with a stenographic machine, comprising:

a bracket for mounting to a support of the stenographic machine, said bracket having a horizontal member and a vertical member extending from said horizontal member;

means for mounting said horizontal member to be vertically adjustable along the support for the stenographic machine;

a support pad which is mounted upon a pad support plate; means for horizontally adjusting said support pad relative to said pad support plate; and means for rotationally mounting said pad support plate to said vertical member of said bracket to permit said pad to be rotated relative to the stenographic machine.

2. The adjustable support as described in claim 1, wherein said means for mounting said horizontal member to the support comprises a first mounting plate extending from said horizontal member and a second mounting plate which is matingly engaged with said first mounting plate to surround the machine support.

3. The adjustable support as described in claim 2, further comprising a threaded aperture formed in said first mounting plate and a threaded aperture formed in said second mounting plate, said apertures overlapping upon mating engagement of said mounting plates to permit the insertion of a threaded tightening bolt.

4. The adjustable support as described in claim 2, wherein said first and second mounting plates are contoured to receive the machine support.

5. The adjustable support as described in claim 1, wherein said means for rotationally mounting said pad support plate to said vertical member comprises:

a pair of spaced apart fingers extending from said vertical member, said fingers defining a vertically extending channel therebetween;

at least one pair of apertures formed through said pair of fingers at a predetermined position;

said pad support plate having a horizontal support for supporting said pad and a base extending from said horizontal support, said base having an aperture formed therethrough which is threaded and which aligns with threads on said at least one pair of apertures in said fingers; and a threaded tightening bolt which mounts said base within said vertically extending channel to enable said pad support plate to be rotatable about an axis formed by said apertures.

6. The adjustable support as described in claim 5, wherein said means for horizontally adjusting said support pad along said pad support plate comprises:

a pair of elongated channels extending parallel along said horizontal support;

a pair of internally threaded mounting holes formed in an underside of said pad, said mounting holes aligning with said pair of elongated channels; and a pair of threaded mounting bolts which engage said mounting holes through said channels and which permit said pad to be slidable for a given horizontal distance along said support plate.

7. The adjustable support as described in claim 5 wherein said at least one pair of apertures is a first pair of apertures at a first predetermined position along said fingers and a second pair of apertures at a second predetermined position above said first pair of apertures, said respective pairs of apertures each receivably mounting said support plate at a different vertical position of said bracket.

8. The adjustable support as described in claim 5 wherein said bracket and said support plate are constructed of a lightweight metal.

9. The adjustable support as described in claim 5 wherein said bracket and said support plate are constructed of a durable plastic.

10. The adjustable support as described in claim 1, wherein said means for mounting said horizontal member to the support comprises a first gripping portion and a second gripping portion, said first and second gripping portions extending from said horizontal member and surrounding the stenographic support.

11. The adjustable support as described in claim 10, further comprising a threaded shaft rotatingly mounted through an aperture in said second gripping portion, said shaft having a knob at one end and an inner portion at an opposite end, said inner portion engaging the support upon rotation of said knob.

12. The adjustable support as described in claim 1, wherein said means for rotationally mounting said pad support plate to said vertical member comprises:

an end portion extending from said vertical member, said end portion terminating in a pair of spaced apart fingers which define an open channel therebetween;

said pad support plate having a horizontal support for supporting said pad and a pair of spaced-apart members extending downwardly from said horizontal support;

a pair of apertures formed through said spaced-apart members, said apertures aligning with opposite ends of said open channel of said spaced-apart fingers when said pad support plate is positioned atop said end portion; and an internally threaded shaft for mounting said spaced-apart members at said opposite ends of the channel defined between said fingers, said shaft being rotated by a knob located at one end of said shaft so as to engage said apertures on opposite sides of said channel and a nut attaching to an opposite end of said shaft so as to draw said spaced-apart members against opposite sides of said fingers, said pad support plate being rotatable about an axis formed by said apertures.

* * * * *